US007084733B2

(12) United States Patent
Harada et al.

(10) Patent No.: US 7,084,733 B2
(45) Date of Patent: Aug. 1, 2006

(54) CHIP-TYPE ELECTRONIC COMPONENT AND CHIP RESISTOR

(75) Inventors: Mitsuru Harada, Osaka (JP); Kazunori Omoya, Osaka (JP); Masato Hashimoto, Fukui (JP); Akio Fukuoka, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 88 days.

(21) Appl. No.: 10/239,617

(22) PCT Filed: Jan. 24, 2002

(86) PCT No.: PCT/JP02/00496

§ 371 (c)(1),
(2), (4) Date: Dec. 12, 2002

(87) PCT Pub. No.: WO02/059913

PCT Pub. Date: Aug. 1, 2002

(65) Prior Publication Data

US 2003/0147200 A1 Aug. 7, 2003

(30) Foreign Application Priority Data

Jan. 25, 2001 (JP) ..... 2001-016652

(51) Int. Cl.
*H01C 1/012* (2006.01)

(52) U.S. Cl. ..... 338/309; 338/313; 338/332

(58) Field of Classification Search ..... 338/309, 338/313, 332

See application file for complete search history.

(56) References Cited

FOREIGN PATENT DOCUMENTS

| | | | |
|---|---|---|---|
| JP | 61-268001 | | 11/1986 |
| JP | 05-326202 | | 12/1993 |
| JP | 7-192257 | * | 7/1995 |
| JP | 07-272909 | | 10/1995 |
| JP | 08-213203 | | 8/1996 |
| JP | 10-121012 | * | 5/1998 |

OTHER PUBLICATIONS

English machine translation to SHInichi et al. (JP08-213203) Aug. 1996.*
Englsih translation to Abe et al., JP 07-017770 (Aug. 1996).*
Machine english translation to Murayama et al. (May. 1998) above.*

* cited by examiner

*Primary Examiner*—K. Lee
(74) *Attorney, Agent, or Firm*—RatnerPrestia

(57) ABSTRACT

In chip electronic components, the application state of conductive paste that makes side electrodes can be optically distinguished in the production of small-sized chip electronic components. The chip electronic component comprises a substrate, and side electrodes disposed at the end portions of the substrate. The lightness of an entire surface of the side electrode is not more than 6 as defined in JIS-Z8721.

9 Claims, 2 Drawing Sheets

CHIP-TYPE ELECTRONIC COMPONENT AND CHIP RESISTOR

This application is a U.S. National Phase Application of PCT International Application PCT/JP02/00496.

TECHNICAL FIELD

The present invention relates to chip electronic components used in various electronic apparatuses, and chip resistors. Particularly, the present invention relates to a very small-sized chip electronic components.

BACKGROUND ART

Recently, a demand for miniaturization or dimensional reduction of electronic apparatuses is more and more increasing, and as a result, very small-sized chip electronic components are increasingly employed as electronic components. Particularly, very small-sized chip electronic components which are as small as 0.6 mm in length ×0.3 mm in width ×0.25 mm in thickness are manufactured in recent years.

A conventional chip electronic component with be described in the following taking a chip resistor as an example.

FIG. 3 is a perspective view showing the structure of a conventional chip resistor. FIG. 4 is a sectional view of the chip resistor.

In FIG. 3 and FIG. 4, a pair of surface electrode layers 2 are formed at both ends of the surface of a substrate 1 made of 96 alumina substrate. The surface electrode layers 2 are made of a silver cermet thick film electrode. Resistor layer 3 is formed so as to be electrically connected to a pair of surface electrode layers 2, and the resistor layer 3 is made up of ruthenium thick film resistor. Protective layer 4 is formed so as to completely cover the resistor layer 3, and the protective layer 4 is made of an epoxy resin. A pair of side electrodes 5 disposed so as to be electrically connected to the pair of surface electrode layers 2 at both ends of the substrate 1 are made of silver cermet thick film. Nickel plated layers 6 and solder plated layers 7 are formed so as to cover exposed portions of the side electrodes 5 and the surface electrode layers 2. The nickel plated layer 6 and solder plated layer 7 are formed in order to maintain the soldering property of side electrodes of the electronic component. Thus, a chip electronic component comprises external electrodes formed by side electrodes 5, nickel plated layers 6 and solder plated layers 7.

For a purpose of avoiding a change of the resistance during a high temperature firing of silver cermet thick film electrode comprising the above side electrodes 5, there is a proposal of using a conductive paste containing thermosetting resin to form the side electrodes 5 (Japanese Patent Laid-open Publication No. 61-26801).

However, as conductive powder is the above conductive paste, generally used is flake silver powder that may realize a low resistance at a low content. Accordingly, the color of the side electrode becomes white after curing. Since the white color is very similar to the color of 96 alumina substrate which makes the substrate, it is not easy to check the application state of conductive paste. That is, even in a case the application state of conductive paste is defective, it is difficult to recognize by checking the appearance.

As a means for checking the application state of the conductive paste, a method of checking the application state of conductive paste by using a conductive paste blended with flake silver powder and spherical silver powder is proposed as is disclosed in Japanese Patent Laid-open Publication 8-213203.

However, due to the recent miniaturization of chip electronic components, it is now difficult to recognize the application state of conductive paste by using the above checking method. That is, if the recognition sensitivity is improved in order to prevent the generation of slightly defective application, it becomes difficult to check the application state of conductive paste since the metallic luster of flake silver powder contained in the paste is very similar to the color of 96 alumina substrate which makes the substrate.

The present invention is intended to address such problem, and the object of the present invention is to provide chip electronic components excellent in mass production feasibility, of which the application state of conductive paste that forms the side electrode may be optically recognized in the production of very small-sized chip electronic components, and a method of manufacturing chip electronic components.

DISCLOSURE OF THE INVENTION

A chip electronic component of the present invention comprises a substrate and side electrodes disposed at both ends of the substrate, and the entire surface of the side electrode has a lightness not more than 6. According to the chip electronic component, the entire surface of side electrode has the lightness of not more than 6 as defined in JIS-Z8721. By the configuration of the present invention, a difference in brightness between substrate and side electrode is made clear, and as a result, even in case of very small-sized chip electronic component, it is possible to recognize the application state of conductive paste at a high speed. Also, it brings about such advantage that the mass production feasibility of chip electronic components may be improved.

DETAILED DESCRIPTION OF PREFERRED EMBODIMENTS

Figure 1:
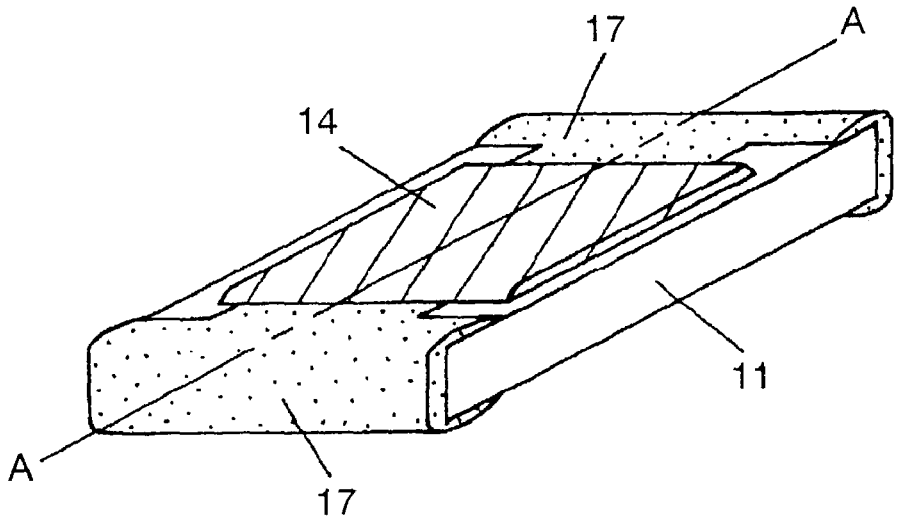
FIG. 1 is a perspective view of a chip resistor in one embodiment of the present invention.
Figure 2:
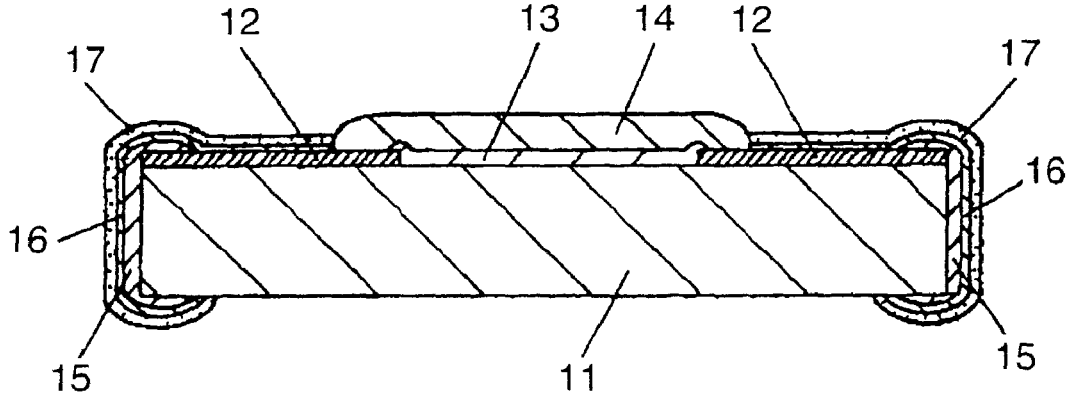
FIG. 2 is a sectional view of A—A line in FIG. 1.
Figure 3:
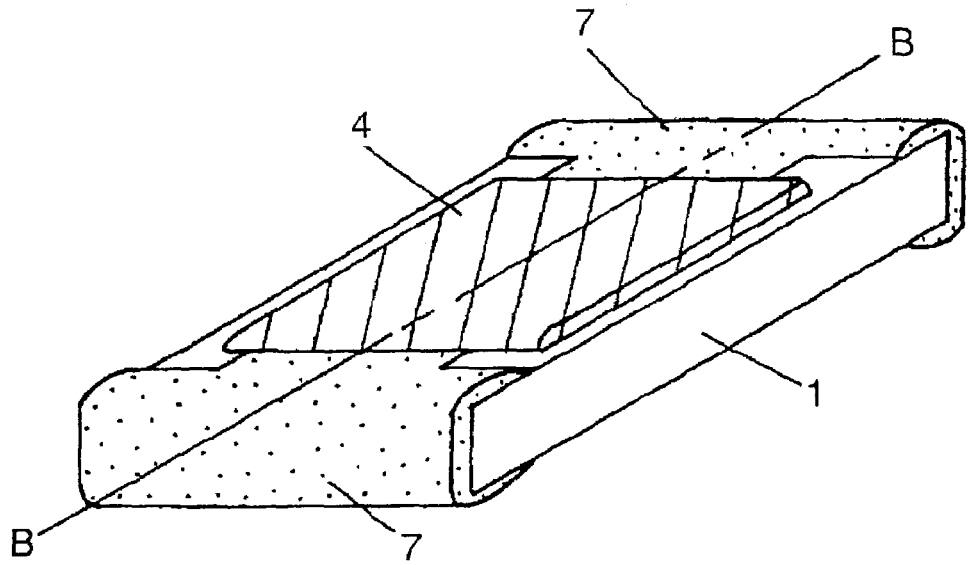
FIG. 3 is a perspective view of a conventional chip resistor.
Figure 4:
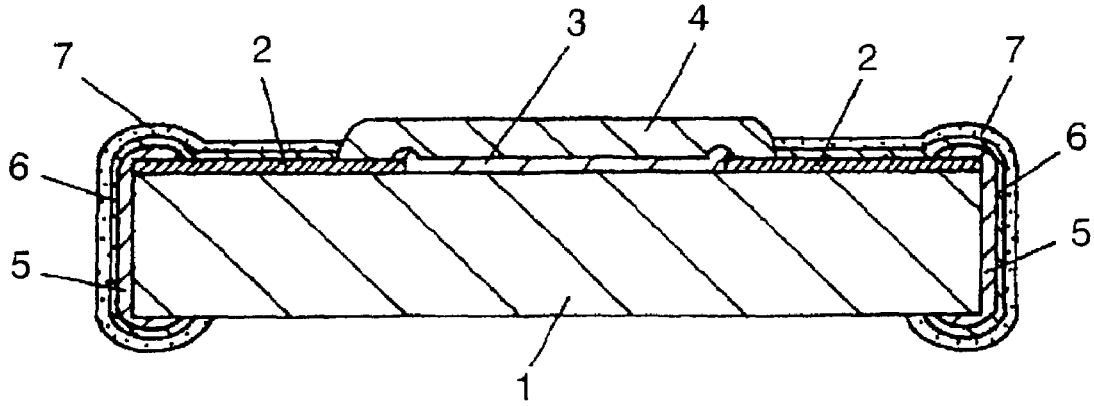
FIG. 4 is a sectional view of B—B line in FIG. 3.

A chip resistor in one embodiment of the present invention will be described in the following with reference to the drawings. FIG. 1 is a perspective view of a chip resistor in one embodiment of the present invention. FIG. 2 is a sectional view of the chip resistor.

In FIG. 1 and FIG. 2, a pair of surface electrode layers 12 are formed at both ends of a surface of substrate 11 made of 96 alumina substrate. The pair of surface electrode layers 12 are made of a silver cermet thick film electrode. Resistor layer 13 is formed to be electrically connected to the pair of surface electrode layers 12. The resistor layer 13 is made of ruthenium thick film resistor. Protective layer 14 is formed to completely cover the resistor layer 13, and the protective layer 14 is made of a epoxy resin. Side electrodes 15 are disposed to be electrically connected to the surface electrode layers 12 at both ends of the substrate 11. In the present preferred embodiment, the side electrodes 15 are formed by applying and curing a conductive paste on the end surfaces of the substrate 11. The conductive paste is prepared by blending thermosetting resin as a binder into the powder mixture of spherical silver powder and carbon. Nickel plated layer 16 and solder plated layer 17 are formed to cover the exposed portions of the side electrodes 15 and the surface electrode layers 12 to maintain the soldering property of a resistor. The external electrodes of the resistor comprises the exposed portions of side electrodes 15 and surface electrode layers 12, nickel plated layers 16 and solder plated layers 17.

Next, a method of manufacturing the chip resistor in the above configuration will be described.

First, a sheet-form substrate made of 96 alumina substrate which is excellent in heat resistance and insulation is prepared. This sheet-form substrate is previously provided with grooves for dividing the substrate into strips and pieces in a later process. The grooves are formed by press forming when the substrate is in the form of a green sheet.

Next, a cermet thick film silver paste is screen-printed and dried on a surface of the sheet-form substrate, followed by a firing in a belt-type continuous furnace to form surface electrode layers 12. The firing condition has a profile of peak temperature of 850° C., peak time of 6 min. and IN-OUT time of 45 min.

Subsequently, a thick film resistance paste based on ruthenium oxide is screen-printed on the surface of the sheet-form substrate to be electrically connected to the surface electrode layers 12, followed by a firing in a belt-type continuous furnace to form resistor layers 13. The firing condition for the resistor layers 13 has a profile of peak temperature of 850° C., peak time of 6 min. and IN-OUT time of 45 min.

Next, in order to make the resistor layers 13 even in resistance, resistance correction is performed by cutting off a part of the resistor layer 13 using a laser beam. The resistance correction is made by L cut by laser beam, at a scanning speed of 30 mm/sec., pulse frequency of 12 KHz and laser output of 5 W.

Next, an epoxy resin paste is screen-printed to completely cover at least the resistor layer 13, followed by a curing of the resin paste in a belt-type continuous oven. The curing condition is a peak temperature of 200° C., peak time of 30 min. and IN-OUT time of 50 min.

Further, as a preparation process for forming side electrodes 15, the sheet-form substrate is divided into strips, thereby exposing the end portion of the substrate for forming the side electrodes 15.

Subsequently, a strip of substrate is fixed by using a holding jig so as to make the side electrode surface horizontal.

Next, a conductive paste is applied onto a side portion of the substrate so as to cover at least the surface electrode layers 12. The conductive paste is manufactured by blending a powder mixture of spherical silver powder and carbon powder having a chain structure into butylcarbitol acetate solution of thermosetting resin, followed by a kneading with a three-roll mill.

The conductive paste is previously applied onto a stainless roller to form a conductive paste layer of about 50 μm uniform thickness. The stainless roller is rotated while the holding jig of the substrate is moved, and the conductive paste on the stainless roller is brought into contact with the side surface of the strip substrate and is applied onto the side surface.

The application state of the conductive paste is checked by observing the lightness of the conductive paste by using a image recognition device. And when the conductive paste is fully applied over the entire side surface of the strip substrate, it is heat-treated in a belt-type continuous far-infrared curing oven. The condition for heat treatment has a temperature profile of peak time of 160° C., 30 min. and IN-OUT time of 40 min. In this way, the side electrodes 15 of about 10 to 20 μm in thickness on the side surface are formed.

After that, the lightness of the side electrode is observed again by using a image recognition device to make sure if the side electrode is formed over the entire side surface of the strip substrate.

Finally, as a preparatory process for electrolytic plating, the strip substrate is divided into individual pieces, and nickel-plated layer 16 and solder-plated layer 17 are formed on the surface electrode layers 12 and side electrode layers 15 exposed on the piece substrate by means of barrel type electrolytic plating. In this way, a chip resistor is completed.

In the present preferred embodiment, since the side electrode 15 is covered with nickel-plated layer 16 and tin-based solder plated layer 17, the resistor is improved in solder wettability and it becomes possible to form a strong side electrode 15.

According to the chip resistor in the above described embodiment of the present invention, a conductive paste containing spherical conductive particles, carbon and resin is used as the material for forming the side electrode 15. Accordingly, when the application state of conductive paste is checked by a image recognition device, there is no problem of faulty recognition such that the state of conductive paste normally applied is judged to be "not applied," thereby assuring highly accurate selection of non-defectives. In other words, in the case of an conventional conductive paste using flake silver powder or flake nickel powder, even with a conductive paste applied, the state of conductive paste normally applied is sometimes judged to be "not applied" when the application is checked by a image recognition device.

The kinds of spherical conductive particles, carbon powder and resin used in a conductive paste in the embodiment of the present invention will be described in the following.

As the conductive particles, spherical, tear drop shape, branch-shape, square, sponge-shape or irregular in shape can be used. In this case, it is more preferable to use particles having nearly spherical shape.

As for carbon powder, it is possible to use carbons such as furnace black, acetylene black, and channel black which are various in kind and quantity.

As the resin, it is possible to use thermosetting resin, ultraviolet-curing resin, electron beam-curing resin, and thermoplastic resin. In this case, it is more preferable to use a thermosetting resin that is excellent in heat resistance and adhesive strength. And as thermosetting resin, it is preferable to use amino resin such as urea resin, melamine resin, and benzoguanamine resin; epoxy resin such as bisphenol-A type and brominated bisphenol-A type epoxy resin; phenolic resin such as resol type and novolac type phenolic resin; and polyimide resin. These may be used individually or in combination of two or more kinds. When epoxy resin is used, it is also possible to use one-component epoxy resin or curing agents such as amines, imidazoles, anhydrides or cationic hardeners. On the other hand, amino resins and phenolic resins can be used as the component of side electrode and also as hardener for the epoxy resin.

It is preferable to add solvents and additives, as required, into the conductive paste containing the spherical conductive particles, carbon and resin.

Solvents that may be used for the conductive paste are, for example, aromatic hydrocarbon solvents such as xylene and ethyl benzen; ketone type solvents such as methyl isobutyl ketone and cyclohexane; ether alcohol, ether ester type solvents such as ethylene glycol monobutyl ether, ethylene glycol monobutyl ether acetate, and diethylene glycol monobutyl ether.

Other additives include, for example, fillers such as silicon oxide, calcium carbonate, and titanium oxide; and leveling agent, thixotropic agent, and silane coupling agent, which can be used in such range that the advantages of the present invention are maintained.

Examples of chip resistor of the present invention will be described in the following. Also, for confirming the advantages of the present invention, comparative examples of chip resistor having side electrode blended with flake silver powder and flake nickel powder are also described. In each of the following examples and comparative examples, the substrate used is 0.5 mm in length, 0.3 mm in width, and 0.25 mm in thickness.

EXAMPLE 1

A structure of a chip resistor in Example 1 of the present invention has the same structure as these of the chip resistor shown in FIG. 1 and FIG. 2. As a resin for the conductive paste for forming side electrodes, bisphenol-A type epoxy resin, a thermosetting resin, and imidazole hardener are used. And spherical silver powder of 0.96 μm in average particle diameter is mixed with the resin at an amount of 85% as spherical conductive particles, and furnace black is further mixed at an amount of 2% as carbon powder.

EXAMPLE 2

A structure of the chip resistor in Example 2 of the present invention has the same structure as the chip resistor in one embodiment of the present invention shown in FIG. 1 and FIG. 2. As the resin for conductive paste for forming side electrodes, bisphenol-F type epoxy resin, a thermosetting resin, and amine hardener are used. And spherical nickel powder of 2.5 μm in average particle diameter is mixed with the resin at an amount of 90% as spherical conductive particles, and furnace black is further mixed at an amount of 1% as carbon powder.

EXAMPLE 3

A structure of the chip resistor in Example 3 of the present invention has the same structure as the chip resistor in one embodiment of the present invention shown in FIG. 1 and FIG. 2. As the resin for conductive paste for forming side electrodes, bisphenol-A type epoxy resin, a thermosetting resin, and imidazole hardener are used. And spherical tungsten powder of 10 μm in average particle diameter is mixed with the resin at an amount of 80% as spherical conductive particles, and furnace black is further mixed at an amount of 3% as carbon powder.

EXAMPLE 4

A structure of the chip resistor in Example 4 of the present invention has the same structure as the chip resistor shown in FIG. 1 and FIG. 2. As the resin for conductive paste for forming side electrodes, resol-type phenolic resin, a thermosetting resin, is used. And spherical silver powder of 28 μm in average particle diameter is mixed with the resin at an amount of 75% as spherical conductive particles, and acetylene black is further mixed at an amount of 2% as carbon powder.

COMPARATIVE EXAMPLE 1

A structure of the chip resistor in the comparative example 1 has the same structure as the chip resistor shown in FIG. 1 and FIG. 2, but the composition of conductive paste for forming side electrodes is different from the structure of each of the above Examples. That is, as the resin for conductive paste for forming side electrodes, the chip resistor in the comparative example 1 uses bisphenol-F type epoxy resin, a thermosetting resin, and amine hardener. And flake silver powder at an amount of 75% and spherical silver powder of 2.5 μm in average particle diameter at an amount of 15% are mixed with the resin as conductive particles, and furnace black is further mixed at an amount of 1% as carbon powder.

COMPARATIVE EXAMPLE 2

A structure of the chip resistor in the comparative example 2 has the same structure as the chip resistor shown in FIG. 1 and FIG. 2, but the composition of conductive paste for forming side electrodes is different from each of the above Examples. That is, as the resin for conductive paste for forming side electrodes, the chip resistor in the comparative example 2 uses bisphenol-F type epoxy resin, a thermosetting resin, and amine hardener. And flake nickel powder at an amount of 5% and spherical silver powder of 2.5 μm in average particle diameter at an amount of 85% are mixed with the resin as conductive particles, and furnace black is further mixed at an amount of 1% as carbon powder.

COMPARATIVE EXAMPLE 3

A structure of the chip resistor in the comparative example 3 has the same structure as the chip resistor shown in FIG. 1 and FIG. 2, but the composition of conductive paste for forming side electrodes is different from each of the above Examples. That is, as the resin for conductive paste for forming side electrodes, the chip resistor in the comparative example 3 uses resol-type bisphenol resin, a thermosetting resin. And flake silver powder at an amount of 2% and spherical silver powder of 28 μm in average particle diameter at an amount of 73% are mixed with the resin as conductive particles, and acetylene black is further mixed at an amount of 2% as carbon powder.

The tests conducted for evaluating the chip resistors in the Examples 1 through 4 of the present invention and the Comparative example 1 through 3 will be described in the following.

In the measurement of the lightness of side electrode, the values definened in JIS-Z8721 are measured by using a image recognition device. As for the application state, in observing the entire surface of side electrode, those having a portion where the lightness is not less than 6 are judged to be defective.

The image recognition test is conducted after application and curing of conductive paste, two times in total. As for the numbers (A) of those judged to be defective in the image recognition test, the manufacturing operation is performed up to the plating process for forming the external electrodes to make it into a finished product, and the result of plating is checked with respect to adhesive strength. The number (B) of those with good result of plating is judged to be of image recognition mistake, and the recognition rate is calculated by the following equation.

$$\text{Recognition rate (\%)}=(\text{Number } A-\text{Number } B/\text{Nmber } A)\times 100$$

The higher the recognition rate, the selectivity in the test is better, and it can be said that the feasibility of mass production is higher. In other words, being low in recognition rate means that those being non-defective in themselves are judges to be defective. Therefore, as a result, it takes much troubles such as re-inspection after plating, greatly worsening the feasibility of mass production.

In the following, as a denominator, 10,000 pieces of chip resistors are manufactured in order to check the recognition rate. The test results of chip resistors in the Examples 1 through 4 of the present invention and the Comparative examples 1 through 3 are shown in Table 1.

TABLE 1

| | Maximum lightness | Recognition rate (%) |
|---|---|---|
| Example 1 | 3 | 100 |
| Example 2 | 5 | 99 |
| Example 3 | 4 | 99 |
| Example 4 | 6 | 98 |
| Comparative example 1 | 8 | 50 |
| Comparative example 2 | 7 | 65 |
| Comparative example 3 | 7 | 70 |

As is apparent in Table 1, since the comparative examples 1 through 3 contain flake conductive particles having metallic luster, they are remarkably lowered in recognition rate as the lightness is increased. On the other hand, in the Examples 1 through 4 of the present invention, they are lower in lightness and higher in recognition rate because of using spherical conductive particles and carbon.

In each Example of the present invention, a substrate for the chip resistor measuring 0.5 mm in length, 0.3 mm in width and 0.25 mm in thickness is used as an example, but the substrate is not limited to this size. As is obvious from the principle of the present invention, the advantages of the present invention can be properly obtained by using various kinds of substrates different in size such as 0.9 to 1.0 mm in length, 0.4 to 0.6 mm in width, or 0.5 to 0.6 mm in length, 0.25 to 0.35 mm in width, etc.

Also, in the above Examples, silver powder, nickel powder or tungsten powder are described as conductive particles, but the conductive particles are not limited to these. It is preferable to use molybdenum powder or copper powder, and further preferable to use one of the mixture of these or plated powder. Particularly, when silver powder is used as conductive particles, the predetermined low conductivity can be obtained because of high conductivity of silver. Thus, since the resin ratio in the paste is relatively increased, it is possible to obtain side electrodes having excellent strength. On the other hand, when nickel, tungsten, molybdenum, and copper are used, the content of conductive particles becomes higher as compared with the case of silver, but these are inexpensive and it is possible to reduce the production cost.

And also, in each of the above Examoples, conductive particles using spherical powder of 0.06 μm in average particle diameter, spherical nickel powder of 2.5 μm in average particle diameter, spherical tungsten powder of 10 μm in average particle diameter, and spherical silver powder of 28 μm in average particle diameter are described. However, the average particle diameters are not limited to these, but a range from 0.05 to 30 μm is preferable. When the average particle diameter of conductive particles is smaller than 0.05 μm, it is necessary to increase the mixing rate of conductive particles in order to obtain the intended resistance, and this is not practical in terms of strength and cost. When the average particle diameter of conductive particles is larger than 30 μm, the side electrode becomes thicker, and the thickness gives influences to the overall sizes normalized for small chip electronic components, which is therefore not preferable. Accordingly, when the average particle diameter of conductive particles is in a range from 0.05 to 30 μm, it is really practical in terms of strength and cost, and will not give influences to the overall sizes normalized for small chip electronic components.

Further, in the above Examples, as the content of conductive particles in side electrodes, spherical silver powder mixed at an amount of 85%, spherical nickel powder mixed at an amount of 90%, spherical tungsten powder mixed at an amount of 80%, and spherical silver powder mixed at an amount of 75% are described. However, the contents are not limited to these, but a range from 75 to 97% is preferable. When the content of spherical conductive particles is less than 75%, the resistance of the side electrodes becomes higher, causing the nickel plated layer to be hard to adhere to the side electrodes. On the other hand, when the content of conductive particles is more than 97%, it is not practical in terms of strength and cost. Accordingly, when the content of conductive particles is in a range from 75 to 97%, it is really practical in terms of strength and cost, making the nickel plated layer easier to adhere to the side electrode.

Further, in each of the Examples of the present invention, chip resistor is described as an example of chip electronic component, but as is obvious from the measuring principle of the present invention, chip electronic component is not limited to the chip resistor. That is, the advantages of the present invention may be similarly obtained against any chip electronic components having side electrodes.

Industrial Applicability

As described above, the chip electronic component of the present invention comprises a substrate, and side electrodes disposed at the end portions of the substrate, and the lightness is not more than 6 over the entire surface of the side electrode. Accordingly, the difference in brightness is clear between the substrate and the side electrode, and as a result, it is possible to check the application state of conductive paste at a high speed even in case of very small-sized chip electronic components. Thus, it brings about such advantage that the mass production feasibility of chip electronic components may be improved.

The invention claimed is:

1. A chip electronic component comprising:

a substrate; and a side electrode disposed at an end portion of said substrate, said side electrode includes spherical conductive particles, carbon and resin, a content of said spherical conductive particles of said side electrode is in a range from 75 to 97%, and the side electrode reflects less light then the substrate.

2. The chip electronic component of claim 1, wherein said spherical conductive particles are selected from the group consisting of single powder of silver, nickel, tungsten, molybdenum, and copper, a mixed powder of these, and plated powder.

3. The chip electronic component of claim 1, wherein the average particle diameter of said conductive particles is in a range from 0.05 to 30 μm.

4. The chip electronic component of claim 1, wherein a size of said substrate is 0.9 to 1.0 mm in length and 0.4 to 0.6 mm in width.

5. The chip electronic component of claim 1, wherein a size of said substrate is 0.5 to 0.6 mm in length and 0.25 to 0.35 mm in width.

6. The chip electronic component of claim 1, wherein said side electrode is covered with a plated layer made of at least one selected from the group consisting of nickel, tin, and alloys of these.

7. A chip electronic component according to claim 1, wherein said side electrode excludes silver flakes.

8. A chip resistor comprising:

a substrate;

a surface electrode layer disposed at an end portion of a surface of said substrate;

a resistor layer electrically connected to said surface electrode; and a side electrode disposed at an end portion of said substrate and electrically connected to said surface electrode layer, said side electrode includes spherical conductive particles, carbon and resin, a content of said spherical conductive particles of said side electrode is in a range from 75 to 97%, and the side electrode reflects less light than said substrate.

9. A chip electronic component according to claim 8, wherein said side electrode excludes silver flakes.

* * * * *